United States Patent [19]

Polgar, Jr. et al.

[11] 3,999,185

[45] Dec. 21, 1976

[54] PLURAL ANTENNAS ON COMMON SUPPORT WITH FEED LINE ISOLATION

[75] Inventors: Michael Stephen Polgar, Jr., Oceanport; Charles Peter Majkrzak, Nutley, both of N.J.

[73] Assignee: International Telephone and Telegraph Corporation, Nutley, N.J.

[22] Filed: Dec. 23, 1975

[21] Appl. No.: 643,882

[52] U.S. Cl. ..... 343/709; 343/885; 343/895

[51] Int. Cl.[2] ..... H01Q 1/34; H01Q 1/52

[58] Field of Search ..... 343/709, 885, 895, 787, 343/788

[56] References Cited

UNITED STATES PATENTS

| | | | |
|---|---|---|---|
| 3,680,146 | 7/1972 | Leitner et al. | 343/885 |
| 3,818,488 | 6/1974 | Majkrzak et al. | 343/885 |

*Primary Examiner*—Eli Lieberman

*Attorney, Agent, or Firm*—John T. O'Halloran; Alfred C. Hill

[57] ABSTRACT

The structure includes a tunable high power MF/HF transmitting antenna having a vertical axis and a shorting assembly driven along the vertical axis to tune the high power antenna. A hollow rotating drive shaft is disposed coaxially of the vertical axis within and coupled to the shorting assembly to drive the shorting assembly. A plurality of additional antennas are disposed in a vertical stacked arrangment above the high power antenna. A plurality of service conductors each coupled to a different one of the plurality of additional antennas are enclosed in a conduit disposed coaxially of the vertical axis and within the drive shaft. A tunable ferrite isolator is disposed below the drive shaft and includes the conduit to enable the conduit and the service conductors to pass through the high power antenna with a minimum of modification to the performance of the high power antenna.

11 Claims, 1 Drawing Figure

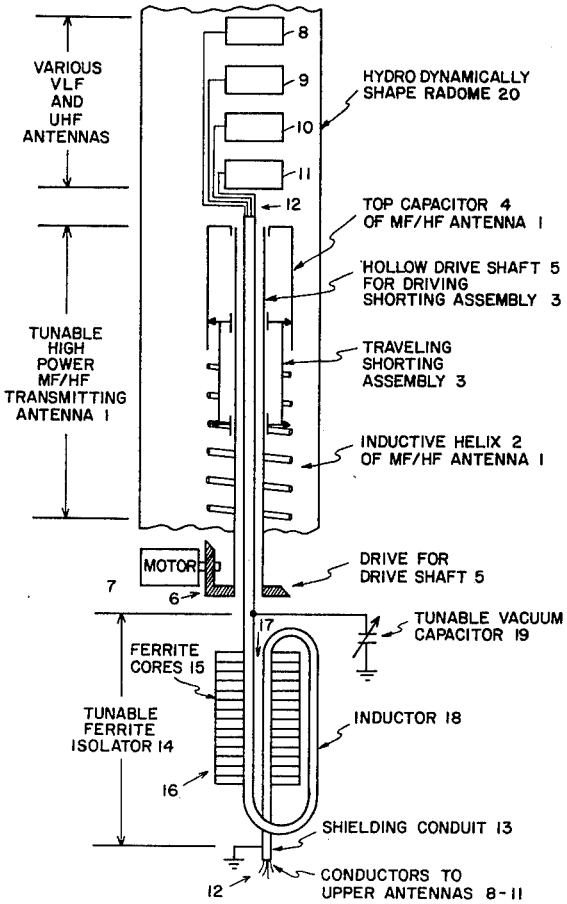

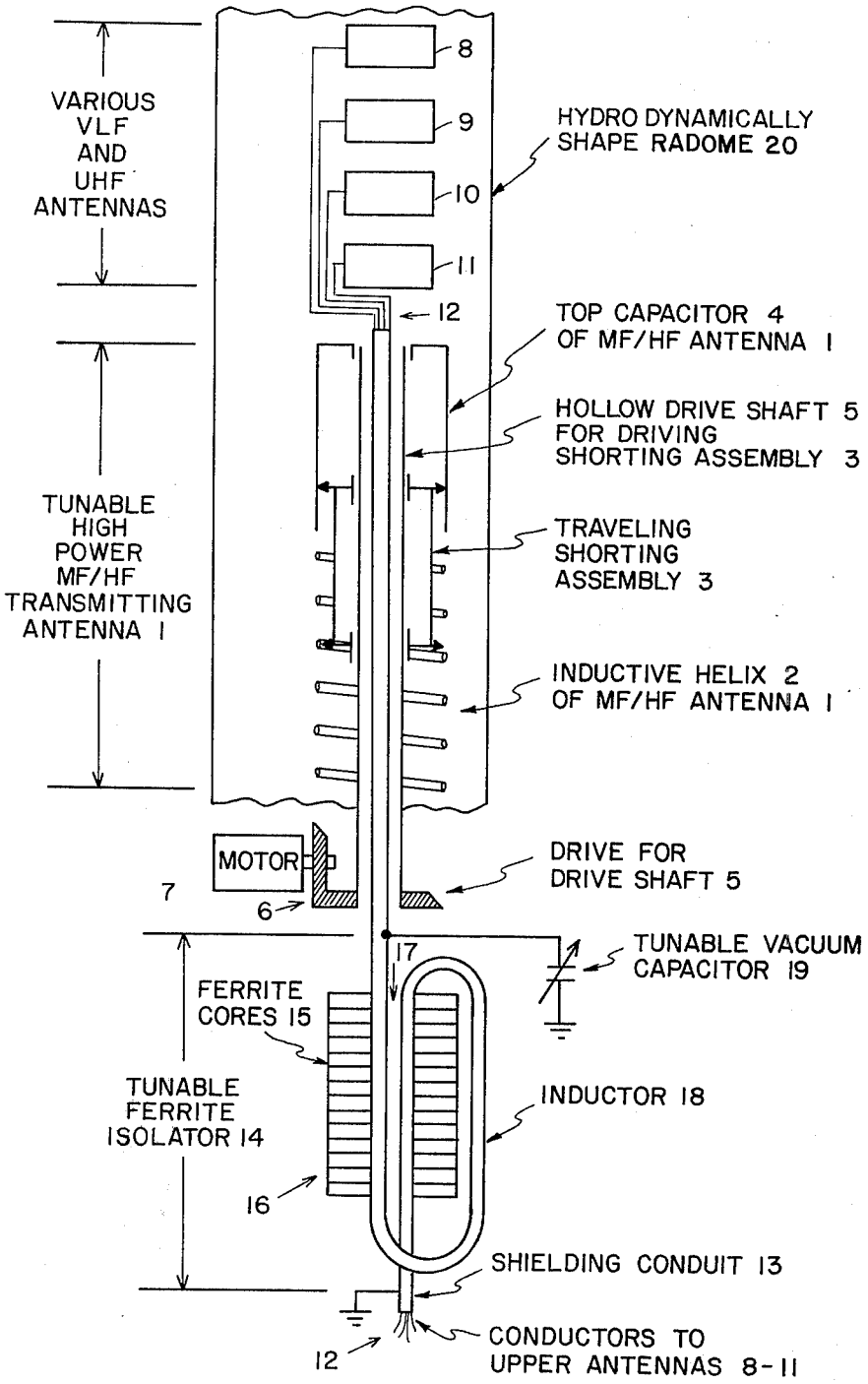
VARIOUS VLF AND UHF ANTENNAS
8
9
10
11
12
HYDRO DYNAMICALLY SHAPE RADOME 20
TOP CAPACITOR 4 OF MF/HF ANTENNA 1
HOLLOW DRIVE SHAFT 5 FOR DRIVING SHORTING ASSEMBLY 3
TUNABLE HIGH POWER MF/HF TRANSMITTING ANTENNA 1
TRAVELING SHORTING ASSEMBLY 3
INDUCTIVE HELIX 2 OF MF/HF ANTENNA 1
MOTOR
7
6
DRIVE FOR DRIVE SHAFT 5
17
TUNABLE VACUUM CAPACITOR 19
FERRITE CORES 15
TUNABLE FERRITE ISOLATOR 14
INDUCTOR 18
16
SHIELDING CONDUIT 13
12
CONDUCTORS TO UPPER ANTENNAS 8-11

PLURAL ANTENNAS ON COMMON SUPPORT WITH FEED LINE ISOLATION

BACKGROUND OF THE INVENTION

This invention relates to antennas and more particularly to a single multipurpose antenna structure.

Because of their higher speed, deeper submergence, and the increasing need for a more covert operation, modern submarines require communication facilities that are reliable, durable, and capable of operation with the lowest practical detectability. This is especially true for antennas.

One means towards achieving these needs is to decrease the number of required individual shipboard antennas by combining them into a single multipurpose antenna structure wherein the highest obtainable efficiencies are provided compatible with a practical size, form and ease of deployment.

A multipurpose antenna for submarine use embraces the transmission and reception of radio signals in various sectors of the frequency range from VLF (very low frequency) upwards through UHF (ultra high frequency). For practical reasons, the various antennas are stacked above one another within a hydrodynamically-shaped radome at levels dictated by the performance requirements of each individual antenna. Accordingly, the high-powered MF/HF (medium frequency/-high frequency) transmitting antenna is relegated to the bottom-most level of the stack of antennas.

In order to serve the various antennas above the MF/HF antenna, their signal wires or cables must pass around or through the high-powered MF/HF antenna. When such conductors are passed around the MF/HF antenna, they must be enclosed in a shielding conduit and be as far removed from the MF/HF antenna as is physically practical because of the tendency for electrical coupling detrimental to MF/HF antenna performance. This displacement is severly limited in a submarine antenna.

To reduce the effects of electrical coupling of the service conductors which is detrimental to MF/HF antenna performance, a mode switch can be used to disconnect all of these conductors for optimum MF/HF performance when it is required. The mode switch has two states: multifunction, mean all functions available, and MF/HF only. The MF/HF antenna efficiency in the multifunction mode was 10 decibels less than desired, while the MF/HF only mode provided adequate efficiency. However, this is not completely desirable since all services above the MF/HF antenna would be rendered useless should the mode switch fail in an open position, and optimum MF/HF performance would not be had should the mode switch fail in the closed position.

Should a conduit of service conductors be passed directly through the MF/HF antenna rather than around it, it would tend to couple to the antenna to cause unacceptable performance or to absorb sufficient radiation so as to destroy the use of the conductors within it through overheating. To overcome this phenomenon, wherein a centrally-located conduit tends to couple into the radiated field of the antenna, and, in turn, itself tends to radiate because of mutually-induced current, the use of an isolator can minimize the conduit current. The isolator can be a tunable circuit in concert with the frequency range of the antenna and in series with the conduit to ground so as to effect a very large impedance to the flow of conduit current.

Because of mutual coupling a tunable MF/HF antenna of this type will demonstrate a very high voltage between parts of the radiating antenna and the conduit or, in reality, between the traveling short and its drive shaft since practical design readily permits a drive shaft to be concentric about the conduit. In high-power transmitting antennas, this voltage can be very high, for instance, in the order of 30,000 to 40,000 volts for a 2-KW (kilowatt) output, and of fairly high frequency, such as 2 to 30 megahertz. In submarine applications, practical considerations require the spacing between these elements to be quite limited.

SUMMARY OF THE INVENTION

An object of the present invention is to provide an improved multipurpose antenna structure.

A feature of the present invention is the provision of a single multipurpose antenna structure comprising: a tunable high power MF/HF transmitting antenna having a vertical axis and a shorting assembly driven along the vertical axis to tune the high power antenna; a hollow drive shaft disposed coaxial of the axis within and coupled to the shorting assembly to drive the shorting assembly; means coupled to the drive shaft to rotate the drive shaft; a plurality of additional antennas disposed in a vertical stacked arrangement above the high power antenna; a plurality of service conductors each coupled to a different one of the plurality of additional antennas; a conduit enclosing the service conductors disposed coaxial of the axis and within the drive shaft; and a tunable ferrite isolator disposed below the drive shaft including the conduit to enable the conduit and the service conductors to pass through the high power antenna with a minimum of modification to the performance of the high power antenna.

BRIEF DESCRIPTION OF THE DRAWING

The above-mentioned and other features and objects of the present invention and the manner of obtaining them will become more apparent by reference to the following description taken in conjunction with the drawing, the single FIGURE of which is a schematic illustration of the single multipurpose antenna structure in accordance with the principles of the present application.

DESCRIPTION OF THE PREFERRED EMBODIMENT

Referring to the FIGURE, the single multipurpose antenna structure in accordance with the principles of the present invention includes a tunable high power MF/HF transmitting antenna 1 having a stationary inductive helix 2 disposed coaxially of a vertical axis of antenna 1, a rotating and translating shorting assembly 3 disposed coaxially of the vertical axis and within helix 2 to tune antenna 1, and a stationary top capacitor 4 in the form of a cylinder which is disposed coaxially of the vertical axis and above helix 2. The shorting assembly includes on the lower end thereof a plurality of rollers and graphite brushes which provides the shorting element for helix 2 to tune antenna 1 and also to enable the shorting assembly 3 to travel along the helix 2 when the drive shaft 5 is rotated by means of the gear train 6 and motor 7. The upper end of shorting assembly 3 also includes rollers and graphite brushes that short and also support the upper end of shorting assembly 3 on the inner surface of capacitor 4 which also acts as a guide for the upper end of the traveling shorting assembly 3.

Disposed in a vertical stacked arrangement with antenna 1 are a plurality of additional antennas 8 – 11 operating at different frequencies in a frequency range from VLF (very low frequency) to UHF (ultra high frequency). Service conductors 12 for antennas 8 – 11 are enclosed in a shielding conduit 13 that is disposed coaxially of the vertical axis and within drive shaft 5.

To provide an efficiency for antenna 1 comparable to the MF/HF only mode of the mode switch of the prior art while simultaneously retaining all the multifunctions performance, the mode switch of the prior art is replaced by a tunable ferrite isolator 14. Isolator 14 includes 14 ferrite cores 15 which may be purchased from Ceramic Magnetic Corporation and is identified by their type number C2050. Each of the cores have a 4 inch outer diameter, a 2 inch inner diameter and are 1 inch thick. These cores are stacked to form a ferrite cylinder 16. The shielding conduit 13 which may be a ½ inch copper pipe is wound through the center hole 17 of ferrite cylinder 16 to form a two-turn inductor 18. A tunable vacuum capacitor 19 connected to conduit 13 is then used to tune inductor 18 to resonance in the 2 to 7 megahertz band. It is a well-known fact that the current flow on a conductor can be decreased by inserting a high impedance in the current path. Isolator 14 presents a high impedance across its terminals at the frequency of its resonance. As previously mentioned, drive shaft 5 that tunes antenna 1 is metal and has a hole in its center. The service cables 12 for antennas 8 – 11 are routed through conduit 13 which in turn is routed through the hole in drive shaft 5. This arrangement shields conductors 12 from the high voltages and currents of antenna 1.

The entire antenna structure is enclosed in a hydrodynamically shaped radome 20.

The presence of the isolator modifies the performance of the MF/HF antenna 1 in the following ways: (1) its efficiency is slightly reduced, (2) the distributed capacity increases, and (3) it has a multiplicity of tuning points.

The degree to which isolator 14 modifies the normal antenna 1 performance is related to its losses. The lower the loss, the higher the parallel resonant impedance which reduces the current induced on drive shaft 5. This lower current minimizes the reduction of radiation resistances, since the drive shaft induced current is intercepted displacement current which would have gone into radiation. The metallic drive shaft 5 increases the effective distributed capacity. The magnitude of increase is related to the resonance of isolator 14. If isolator 14 resonants at the same frequency as antenna 1, the increase of capacity is between one-third and one-half the static capacity. When isolator 14 is detuned, the increase in distributed capacity is equal to the static capacity.

The fact that the distributed capacity is a variable dependent on frequency radically changes the tuning characteristics of antenna 1. Antenna 1 is a resonant circuit with harmonically related resonances. Since the conditions for resonance include the distributed capacity and the distributed capacity has at least two values for each physical tuning arrangement, there will be a doubling of the number of harmonically related resonances. This can make the tuning of antenna 1 very difficult but certain quidelines become obvious: (1) ferrite isolator 14 is tuned to the operating frequency, (2) antenna 1 is tuned to resonance using the normal reflectometer or other indicator of resonance, and (3) an additional adjustment of resonance that may be necessary to correct for drift is accomplished by readjusting antenna 1 and not isolator 14.

While we have described above the principles of our invention in connection with specific apparatus it is to be clearly understood that this description is made only by way of example and not as a limitation to the scope of our invention as set forth in the objects thereof and in the accompanying claims.

We claim:

1. A single multipurpose antenna structure comprising:
   - a tunable high power medium frequency/high frequency transmitting antenna having a vertical axis and a shorting assembly driven along said vertical axis to tune said high power antenna;
   - a hollow drive shaft disposed coaxial of said axis within and coupled to said shorting assembly to drive said shorting assembly;
   - means coupled to said drive shaft to rotate said drive shaft;
   - a plurality of additional antennas disposed in a vertical stacked arrangement above said high power antenna;
   - a plurality of service conductors each coupled to a different one of said plurality of additional antennas;
   - a conduit enclosing said service conductors disposed coaxial of said axis and within said drive shaft; and
   - a tunable ferrite isolator disposed below said drive shaft including said conduit to enable said conduit and said service conductors to pass through said high power antenna with a minimum of modification to the performance of said high power antenna.

2. A structure according to claim 1, wherein said high power antenna further includes
   - an inductive helix disposed coaxial of said axis and outside said shorting assembly, said shorting assembly having the lower end thereof traveling on and shorting said helix; and
   - a capacitive cylinder disposed coaxial of said axis above said helix, the inner surface of said cylinder being shorted by said shorting assembly and providing a support and guiding surface for the upper end of said shorting assembly.

3. A structure according to claim 2, wherein said isolator includes
   - a plurality of ferrite cores stacked one above the other to form a hollow ferrite cylinder,
   - said conduit being passsed through said ferrite cylinder to form at least a two-turn inductor, and
   - a tunable vacuum capacitor coupled to said conduit between said ferrite cylinder and said drive shaft to tune said isolator.

4. A structure according to claim 3, wherein said means includes
   - a gear train coupled to an end of said drive shaft adjacent to said isolator, and
   - a motor coupled to said gear train.

5. A structure according to claim 4, further including a hydrodynamically shaped radome enclosing said structure for utilization on a submarine.

6. A structure according to claim 1, wherein said isolator includes
   - a plurality of ferrite cores stacked one above the other to form a hollow ferrite cylinder,
   - said conduit being passed through said ferrite cylinder to form at least a two-turn inductor, and a tunable vacuum capacitor coupled to said conduit between said ferrite cylinder and said drive shaft to tune said isolator.

7. A structure according to claim 6, wherein said means includes a gear train coupled to an end of said drive shaft adjacent to said isolator, and a motor coupled to said gear train.

8. A structure according to claim 7, further including a hydrodynamically shaped radome enclosing said structure for utilization on a submarine.

9. A structure according to claim 1, wherein said means includes a gear train coupled to an end of said drive shaft adjacent to said isolator, and a motor coupled to said gear train.

10. A structure according to claim 9, further including a hydrodynamically shaped radome enclosing said structure for utilization on a submarine.

11. A structure according to claim 1, further including a hydrodynamically shaped radome enclosing said structure for utilization on a submarine.

* * * * *